US011147150B2

(12) United States Patent
Travish et al.

(10) Patent No.: US 11,147,150 B2
(45) Date of Patent: Oct. 12, 2021

(54) X-RAY GENERATOR

(71) Applicant: ADAPTIX LTD, Begbroke (GB)

(72) Inventors: Gil Travish, Oxford (GB); Sami Mughal, Oxford (GB)

(73) Assignee: ADAPTIX LTD, Begbroke (GB)

( * ) Notice: Subject to any disclaimer, the term of this patent is extended or adjusted under 35 U.S.C. 154(b) by 0 days.

(21) Appl. No.: 16/781,860

(22) Filed: Feb. 4, 2020

(65) Prior Publication Data

US 2020/0178379 A1 Jun. 4, 2020

Related U.S. Application Data

(63) Continuation of application No. PCT/GB2018/052126, filed on Jul. 27, 2018.

(30) Foreign Application Priority Data

Aug. 4, 2017 (GB) ..... 1712558

(51) Int. Cl.

| | |
|---|---|
| ***H05G 1/52*** | (2006.01) |
| ***H01J 35/14*** | (2006.01) |
| ***H01J 35/30*** | (2006.01) |
| ***H05G 1/26*** | (2006.01) |
| ***H05G 1/56*** | (2006.01) |

(52) U.S. Cl.

CPC ..... *H05G 1/52* (2013.01); *H01J 35/147* (2019.05); *H01J 35/153* (2019.05); *H01J 35/30* (2013.01);

(Continued)

(58) Field of Classification Search

CPC ..... H05G 1/52; H05G 1/265; H05G 1/70; H05G 1/56; H05G 1/30; H01J 35/147;

(Continued)

(56) References Cited

U.S. PATENT DOCUMENTS 5,610,967 A * 3/1997 Moorman ..... A61B 6/12 378/154
2002/0003861 A1* 1/2002 Rick ..... A61B 6/481 378/98.12

(Continued)

FOREIGN PATENT DOCUMENTS

DE 102012216005 3/2014
GB 1444109 7/1976

(Continued)

OTHER PUBLICATIONS

WIPO, International Search Report and Written Opinion in corresponding PCT application PCT/GB2018/052126, dated Nov. 12, 2018.

(Continued)

*Primary Examiner* — Chih-Cheng Kao
(74) *Attorney, Agent, or Firm* — Ryan Alley IP

(57) ABSTRACT

To achieve high quality x-ray imaging, it is important to be able to control the production of x-rays in an x-ray generator. This is achieved by an x-ray generator comprising an array of electron field emitters for producing paths of electrons, target material comprising x-ray photon producing material configured to emit x-ray photons in response to the incidence of produced electrons upon it, an array of magnetic-field generators for affecting the paths of the produced electrons from the array of electron field emitters such that one or more paths are divertable away from the x-ray photon producing material so as to reduce the production of x-ray photons by the said one or more paths of electrons, the generator further comprising a sensing circuit arranged to measure the amount of electrical charge emitted by one or more electron emitter, and a controller for controlling the array of magnetic-field generators in response to the amount of electrical charge measured.

19 Claims, 3 Drawing Sheets

(52) U.S. Cl.
CPC ..... *H05G 1/265* (2013.01); *H05G 1/56* (2013.01); *H01J 2235/068* (2013.01)

(58) Field of Classification Search
CPC .... H01J 35/153; H01J 35/30; H01J 2235/068; H01J 35/065
See application file for complete search history.

(56) References Cited

U.S. PATENT DOCUMENTS

| | | | | |
|---|---|---|---|---|
| 2010/0141151 | A1 | 6/2010 | Reinhold | |
| 2012/0269323 | A1 | 10/2012 | Adler et al. | |
| 2014/0219424 | A1* | 8/2014 | Smith | H05G 1/52 378/137 |
| 2015/0092924 | A1 | 4/2015 | Yun et al. | |
| 2015/0110252 | A1* | 4/2015 | Yun | G21K 1/06 378/138 |
| 2019/0311874 | A1* | 10/2019 | Tuohimaa | H01J 35/08 |

FOREIGN PATENT DOCUMENTS

| | | | | |
|---|---|---|---|---|
| GB | 2473137 | | 10/2010 | |
| WO | WO-2015132595 | A1 * | 9/2015 | H01J 35/30 |

OTHER PUBLICATIONS

UK IPO, Search Report in corresponding UK application 1712558.4, dated Dec. 14, 2017.

* cited by examiner

X-RAY GENERATOR

RELATED APPLICATIONS

This application claims priority under 35 U.S.C. § 120 to, and is a continuation of, co-pending International Application PCT/GB2018/052126, filed Jul. 27, 2018 and designating the US, which claims priority to GB Application 1712558.4, filed Aug. 4, 2017, such GB Application also being claimed priority to under 35 U.S.C. § 119. These GB and International applications are incorporated by reference herein in their entireties.

BACKGROUND

Field

The present invention relates to an x-ray generator.

In particular, but not exclusively, the invention relates to an x-ray generator comprising a plurality of x-ray sources, with a means of switching individual x-ray sources on and off and variably controlling the time period for which an individual x-ray source emits x-rays, and to a method of operating such a generator. The invention finds particular, although not exclusive, utility in close-pitch scale x-ray generators.

In recent years, there have been advances in the development of close-pitch scale x-ray sources, such that it is now possible to produce a plurality of x-ray sources with a typical distance between the x-ray sources of the order of 100 μm to 1 cm or more.

An example of such a two-dimensional x-ray source is provided in WO2011017645A2, where all of the sources are operated simultaneously, i.e. at the point of initiating the x-ray emission field emission the surface electrons will occur at each of the field emitters and x-ray photons (bremsstrahlung) will be emitted simultaneously from multiple sites as electrons strike the target material.

For certain x-ray imaging modalities, it may be preferable to be able to control the sequence of the activation of individual x-ray sources within a plurality of x-ray sources. For example, it may be advantageous to activate the x-ray sources in a sequential and row by row manner, known as raster scanning, which is used in many electronic imaging devices.

WO2015132595A1 describes a means of doing this by selectively controlling the individual operation of multiple x-ray sources via a mechanism which does not rely on high voltage switching.

However, it has become apparent that current fluctuations in the multiple electron emission sources used to generate x-ray photons can translate directly into flux variation in the resulting x-ray radiation signal output, thereby reducing the usefulness of the x-ray radiation in determining fine detail in x-ray imaging modalities.

These current fluctuations can result from a wide variety of underlying phenomena including thermal noise, electrical noise, vacuum fluctuations, inherent electron emitter physics and the interplay of several of these factors at the same time. In field enhanced emission sources, voltage fluctuations and microscopic emitter surface changes may be the primary concerns.

SUMMARY

It is an aim of the present invention to overcome these current fluctuations.

In a first aspect, the invention provides an x-ray generator comprising an array of electron field emitters for producing paths of electrons, target material comprising x-ray photon producing material configured to emit x-ray photons in response to the incidence of produced electrons upon it, an array of magnetic-field generators for affecting the paths of the produced electrons from the array of electron field emitters such that one or more paths are divertable away from the x-ray photon producing material so as to reduce the production of x-ray photons by the said one or more paths of electrons, the generator further comprising a sensing circuit arranged to measure the amount of electrical charge emitted by one or more electron emitter, and a controller for controlling the array of magnetic-field generators in response to the amount of electrical charge measured.

In this way, each individual x-ray source activation continues for a dynamically determined period of time, this dynamically determined x-ray activation period continuing until the sensing circuit determines that the associated electron emitter charge exceeds a pre-determined threshold. This allows for individual control of each electron emitter (and thus the generation of x-ray photons from the path of electrons emitted by each electron emitter) so that even if the power supply to each emitter is slightly different, and thus produces more or less electrons, and thus x-rays, as compared to adjacent emitters, the total amount of electrons, and thus x-rays, generated by each emitter is controlled.

In other words, without this system, if a set value of x-ray photons is required and a timer is used to control the generation thereof, some emitters may underperform and some may overperform without collectively producing a constant rate of photons. To avoid having to manage the supply of power to each individual emitter to ensure consistency across all emitters, which would be expensive and difficult, the present system provides a simple yet effective solution by monitoring each emitter individually and controlling its operation (i.e. whether it is "on" or "off") to generate x-rays.

The controller may be arranged to control one or more magnetic-field generators to thereby reduce production of x-ray photons resulting from one or more paths of electrons when the amount of electrical charge, as measured by the sensing circuit in the one or more paths, exceeds a predetermined threshold. The reduction may be total in that no x-ray photons are produced. Each of path of electrons may be served by one or more magnetic-field generators.

The amount of electrical charge measured may be the integral or summation of the current; $Q=\int I dt$ where the integral is over a time interval. Charge sensitive amplifiers and circuits may be used. Also, it may be that a characteristic of the electricity supplied which is proportional to current and integrated is measured. Other methods include charging-up a capacitor and then measuring the discharge time through one or more resistors to measure the charge that was in the capacitor.

It may be desired to measure the current over a specific time period. To do this either current or charge may be measured within that time period (e.g. 100 ms). However, because there is no simple direct measurement of the current, a sensing resistor may be used to measure the voltage drop across that resistor. If the resistance of the sensing resistor is far smaller than the rest of the system resistance, then the voltage drop across the sensing resistor will be small compared to the supply voltage, and the measurement will not disrupt the functioning of the device.

The sensing circuit may be arranged between a power source for the one or more electron emitter, and the electron emitter. It may measure voltage drop which may be proportional to supplied current. It may measure this voltage drop across a sensing resistor. Alternatively, or additionally, the sensing circuit may be arranged between the one or more electron emitter, and the target material. Alternatively, or additionally, the sensing circuit may be arranged between the one or more electron emitter, and a controlling grid intermediate of the emitter and target material. In these last two situations, the sensing circuit may measure actual current.

The electronic sensing circuit may be configured to determine the associated electron emitter charge by means of measurement of a diode or triode source current. The electronic sensing circuit may be configured to determine the associated electron emitter charge by means of measurement of a diode or triode sink current. The electronic sensing circuit may be configured to determine the associated electron emitter charge by means of measurement of a triode grid (also known as "gate" or "suppressor") current.

The target may further comprise non-photon producing material onto which the one or more paths of electrons may be diverted by the magnetic-field generators so as to reduce the production of x-ray photons by the said one or more paths of electrons. The non-photon producing material may comprise, or be, interstitial absorption material. The term "non-photon producing material" may also be understood to mean "non-photon emitting material". These terms contemplate the possibility that some photons may be emitted but at a rate substantially lower (by the order of several magnitude) than produced/emitted by the photon producing material. It is possible that the non-photon producing material comprises a combination of materials with a first part of low atomic number materials producing fewer, and lower energy photons, than would be the case in the other target areas. These photons are then absorbed in a second part which has high atomic number materials. In practice, a single material of sufficient thickness may also serve as the non-photon producing material. It is further understood that photons may be produced for any material which are emitted in all directions. Some photons may be produced which travel in a direction opposite to that of the direction of the paths of electrons. These "backwards" photons may not contribute to the imaging flux and are therefore of no concern.

The x-ray generator may be arranged such that the generation of x-rays may be controllable without altering a supply of power to the array of electron field emitters. In other words, without high voltage switching such as turning off the power supplied to one or more electron emitters.

The magnetic-field generators may be energisable solenoid coils. Other types of magnetic-field generators are contemplated such as permanent magnets and mechanisms for moving them relative to the paths of electrons/electron emitters.

The magnetic-field generators may defocus the paths of the electrons.

The x-ray photon producing material in the target material may be arranged in a regular pattern of discrete areas. The array of electron emitters may be arranged in a two-dimensional manner. Likewise, the target material may be two-dimensional.

The ratio of the diameter of a discrete area of target material to the distance between adjacent discrete areas of target material in the regular pattern may be approximately 1:100. Other ranges are contemplated such as between 1:50 and 1:200.

Each discrete area of target material may be a circle having a diameter of approximately 100 μm. Other shapes are contemplated such as octagonal and hexagonal.

The target material may be tungsten, or another material having a relatively high atomic number such as molybdenum, gold and tungsten alloy. The term "relatively high" may mean higher than that of the element iron.

The target material may have a thickness in the range 3 to 12 μm although other ranges are contemplated.

The non-photon producing material may be silicon, although other low atomic number materials or combinations of low atomic materials may be used such as carbon, graphite, carbon-graphite composites, beryllium alloys such as beryllium-copper, aluminium, and aluminium alloys. The term "relatively low" may mean lower than that of the element iron, and/or lower than the "relatively high" atomic target material describe above.

The silicon, or other such low atomic material, may have a thickness in the range 50 to 500 μm, although other ranges are contemplated. The silicon, or other such low atomic material, may be a substrate in which the high atomic material is embedded.

The target material may further comprise a thin sheet of x-ray absorbing material positioned on the side away from the electron field emitters, i.e. behind the target. This thin sheet may comprise aluminium and may have a thickness in the range 0.1 cm to 1 cm although other materials and thicknesses are also contemplated such as copper, aluminium-copper composites and alloys. This sheet may absorb very low energy x-ray photons produced by the action of electrons impinging upon the high atomic number material. This layer may allow for "hardening" or "stiffening" of the spectrum by absorbing the very low energy x-rays which do not contribute to the image formation but do otherwise increase the dose to the patient or target. It is also possible to incorporate this "hardening" layer into the low atomic material region.

A plurality of magnetic lenses may be positioned adjacent to the plurality of magnetic-field generators, the magnetic lenses being arranged such that in use they concentrate the field flux towards the centre of the emitter array.

The controller may also control each magnetic-field generator. Alternatively, a separate controller may be employed for this purpose. The control may be in relation to its operation status (on/off) and/or its location relative to the electron emitters.

The controller may be configured such that adjacent magnetic-field generators are operable in a raster sequence within 1 ms to 5 ms of each other.

Alternatively, or additionally, the controller may be configured to operate a number of magnetic-field generators simultaneously. This may reduce the field each magnetic-field generator has to produce, which may make peak current handling simpler and heat dissipation easier. Furthermore, it may help to localise the fields to the emitter region and reduce the parasitic field at adjacent emitters.

The controller may be configured to operate a number of magnetic-field generators simultaneously as synchronised by a clock signal.

In a second aspect, the invention provides a method of obtaining an x-ray image of an object, comprising the steps of providing an x-ray generator according to the first aspect; providing an x-ray detector; and operating said generator whereby x-ray photons pass through an object positioned between the x-ray source array and the x-ray detector.

The sensing circuit may measure the amount of electrical charge emitted by the one or more electron emitter, and the controller may control the array of magnetic-field generators in response to the amount of electrical charge measured.

The controller may control the array of magnetic-field generators so that the amount of charge emitted by each electron emitter is predetermined. In other words, the controller may stop the emission of charge from an electron emitter when the amount already emitted reaches a predetermined threshold.

Whether the electrons are defocused or diverted may be determined by the alignment of the magnetic-field generators relative to the alignment of the electron field emitters. If the magnetic-field generators are in axial alignment with the electron field emitters and the target area, then a current applied through the magnetic-field generators may cause the electrons to be focused. If the magnetic-field generators are spatially arranged to be laterally offset between the direct alignment of the electron field emitters and the target area, then a current applied through them may cause the electrons to be defocused and diverted.

It has been found that offsetting the magnetic-field generators relative to the electron field emitters may reduce the current density required through magnetic-field generators which are solenoid coils in order to cause a given percentage of electrons to deviate sufficiently from the course they would take with no current applied through the solenoid coils. For this reason, it may be beneficial for solenoid coils to be offset from the electron field emitters, although positioning the solenoid coils in alignment with the electron field emitters may cause the invention to operate in the same fundamental manner but requiring a higher solenoid current. An additional benefit of offset coils is that this may facilitate a clear exit path for the x-rays since the magnetic-field generators are not obstructing the path. The preferred offset is a function of the magnetic field generator and the target geometry and may be in the range of 1-3 mm, although other offset dimensions are possible.

The term "defocusing" may mean the increase in either the area or the diameter of the electron distribution's transverse profile under the influence of a magnetic-field generators. The specific ratio of offset to defocusing that is optimal may be dependent on the target size, distance to the target (cathode-anode spacing), and the emitter pitch, among other factors. In practice, the magnetic-field generators and target parameters may be adjusted until there is a high contrast ratio in the number of photons emitted between the solenoid "on" and "off" states. This ratio is typically 1:100, although other ratios are useful.

It will be understood that the paths of electrons may be actively or passively diverted by the magnetic-field generators to impinge on the x-ray photon producing material. In other words, it may be either the un-deviated paths or the deviated paths of electrons which may be aimed at the x-ray producing material.

BRIEF DESCRIPTION OF THE DRAWINGS

The above and other characteristics, features and advantages of the present invention will become apparent from the following detailed description, taken in conjunction with the accompanying drawing, which illustrate, by way of example, the principles of the invention. This description is given for the sake of example only, without limiting the scope of the invention. The reference figure quoted below refers to the attached drawing.

DETAILED DESCRIPTION

Figure 1:
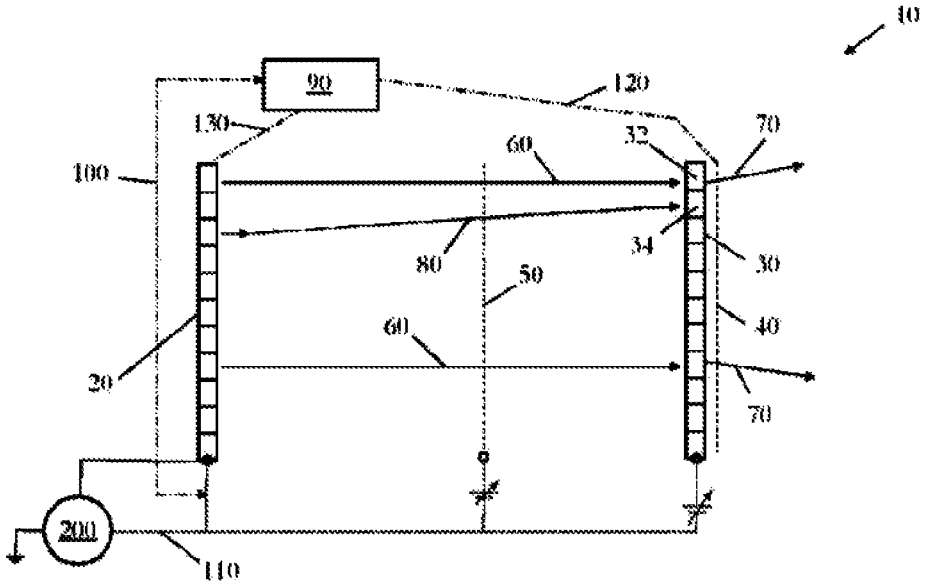
FIG. 1 is a schematic representation of an x-ray generator.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "connected", used in the description, should not be interpreted as being restricted to direct connections only. Thus, the scope of the expression "a device A connected to a device B" should not be limited to devices or systems wherein an output of device A is directly connected to an input of device B. It means that there exists a path between an output of A and an input of B which may be a path including other devices or means. "Connected" may mean that two or more elements are either in direct physical or electrical contact, or that two or more elements are not in direct contact with each other but yet still co-operate or interact with each other. For instance, wireless connectivity is contemplated.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances. The use of the term "any" may mean "all" and/or "each" in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

In FIG. 1, a generator 10 is shown in schematic format comprising an array of electron emitters 20 and a power supply 200. In use, an individual electron emitter may produce a path of electrons 60, 80. If the path of electrons 60 hits an area of x-ray photon producing material 32 located on the target 30, then x-ray photons 70 are produced. However, if the path of electrons 80 hits an area of absorption material 34 located on the target 30, then no x-ray photons are produced.

The paths of the electrons may be controlled by magnetic-field generators 40 arranged "behind" the target 30, relative to the electron emitters 20. It is possible, that the magnetic-field generators 40 are instead of, or as well as, arranged "behind" the electron emitters 20, relative to the target 30. They may be immediately adjacent the emitters.

A controlling grid 50 may be located between the electron emitters 20 and the target material 30. This may be used to control the emission field.

The generator 10 includes a controller 90 connected by control lines 120, 130 to the electron emitters 20 and magnetic-field generators 40. The controller 90 may control each electron emitter 20 and each magnetic-field generator 40 independently and individually.

Furthermore, the generator 10 includes an electronic sensing circuit 110 (shown in dotted lines) for measuring the amount of electrical charge emitted by one or more of the electron emitters 20. This electrical charge may be determined by measuring any one or more of voltage-drop across a sensing resistor and supplied current. This circuit may be connected between the power supply 200 and the emitters 20. Alternatively, or additionally, it may be connected between the target 30 in the case of a diode arrangement, or the controlling grid 50 in the case of a triode arrangement, and the emitters 20.

The magnetic field generators may comprise sixty-four solenoid coils, arranged in a two-dimensional 8×8 array. In this arrangement, with a 1 cm pitch between the solenoids, it is possible to place them "behind" (relative to the electron emitters 20) the x-ray emitters. It is possible to contemplate a general arrangement of m×n x-ray emitters, with a coil arrangement of i×j. In one example, the coil arrangement is m+1×n+1 (i.e. i=m+1 and j=n+1). The arrays are generally located at a specific distance from the x-ray emitters, ensuring that the magnetic field generated by the coils is sufficient to divert or focus/defocus the electron beams as required. Other embodiments such as a 7×7 grid are also contemplated. The arrays may be larger, such as a 40×40 grid of x-ray emitters along with a 41×41 array of coils. Other configurations of x-ray emitters and magnetic generators are contemplated. The x-rays may travel away from the target between the coils.

There exist a number of methods for generating and controlling the required magnetic fields. In the case of coils and current power supplies, a number of control mechanisms can be considered by example. The solenoid coils may be powered through individual coil driving ICs, which can control the amount of power drawn through as well as magnetism generated by each coil. The nature and function of these ICs would be driven by the controller 90. The solenoid coils may be operated individually, or in groups of four to form a quadrupole. Other configurations or combinations of coils may be used to generate the required magnetic field.

An alternative method to this could be an individual power line, through the use of multiplexer devices, which act as a large switching array. Other mechanisms and devices might serve the same purpose of being able to provide power independently to each solenoid to achieve the desired scanning sequence according to the imaging modality being undertaken.

Figure 2:
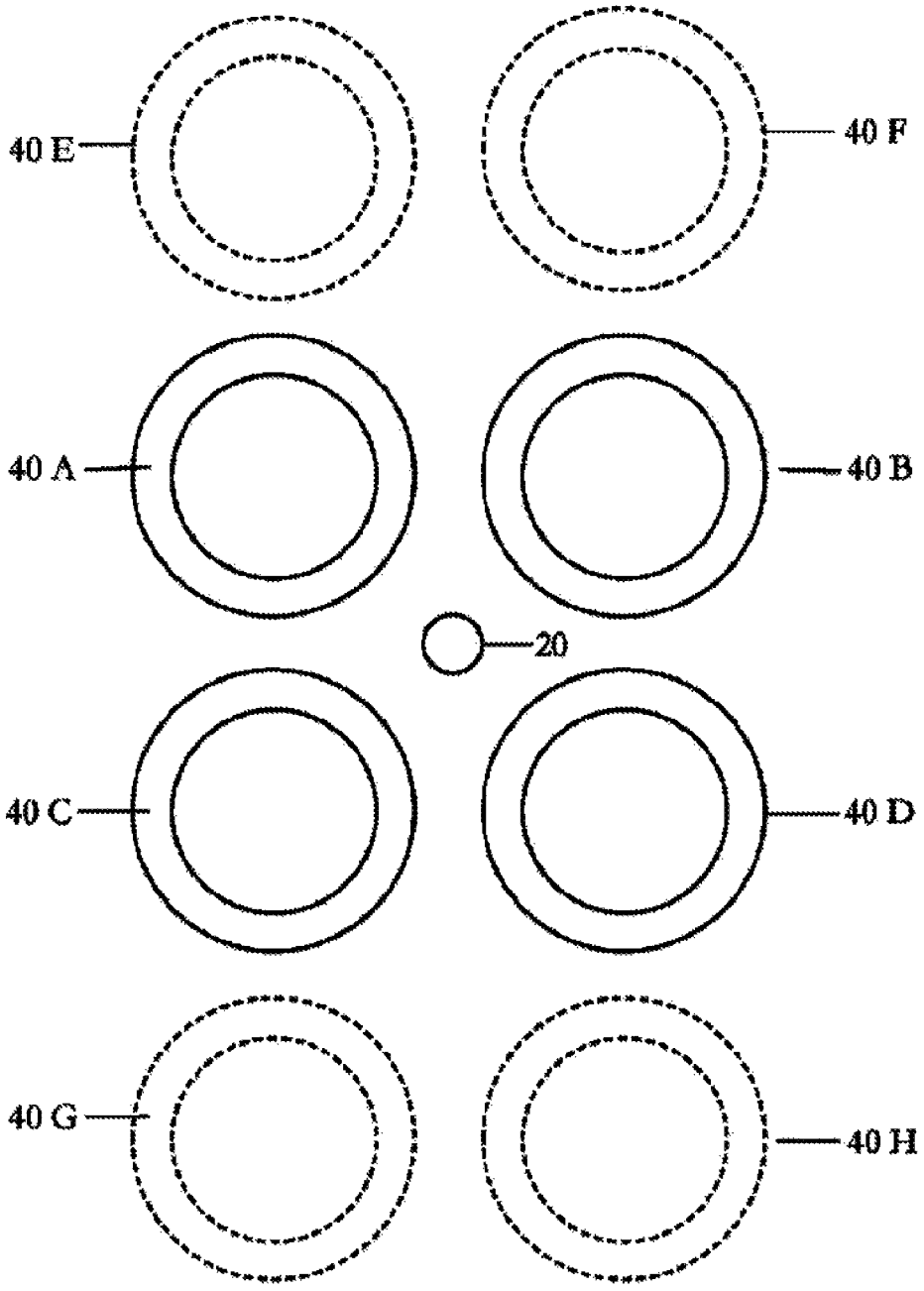
FIG. 2 is a schematic representation of an electron emitter and associated solenoid coils.

In one configuration shown in FIG. 2 (not to scale), four solenoid coils 40A, 40B, 40C, 40D are arranged around each electron emitter 20 with two above 40A, 40B and two below 40C, 40D. It is also possible to include another four solenoid coils 40E, 40F, 40G, 40H such that there are four above and four below the emitter. This arrangement may provide further field suppression outside the intended emitter region.

The coils may be polarized in various (+/−) arrangements to direct the beam of electrons in various different directions.

For instance, coils 40F, 40A, 40C and 40D may be polarized at +2.8 A, with coils 40E, 40B, 40D and 40G being polarized at −2.8 A.

The electron emitters may be formed by a pyroelectric crystal with an upper surface and a conducting film coating the upper surface of the pyroelectric crystal. The pyroelectric crystal may include a plurality of field emitters formed as micrometer-scale exposed regions in the pyroelectric crystal having one or more sharp peaks or ridges. The pyroelectric crystal may be alternately heated and cooled over a period of several minutes with a heater/cooler adjacent the pyroelectric crystal so that spontaneous charge polarisation may occur in the pyroelectric crystal. The spontaneous charge polarisation may cause a perpendicular electric field to arise on the pyroelectric crystal's top and bottom faces, in which case at the exposed surface of the pyroelectric crystal the electric field may be enhanced by the sharp peaks or ridges, thereby causing field emission of surface electrons from that location. The pyroelectric crystal may be lithium niobate.

The acceleration/speed of the electrons may be affected by controlling the potential difference between the cathode and anode in the apparatus, or if a gate is included by controlling the potential difference between the cathode, gate and anode.

Figure 3:
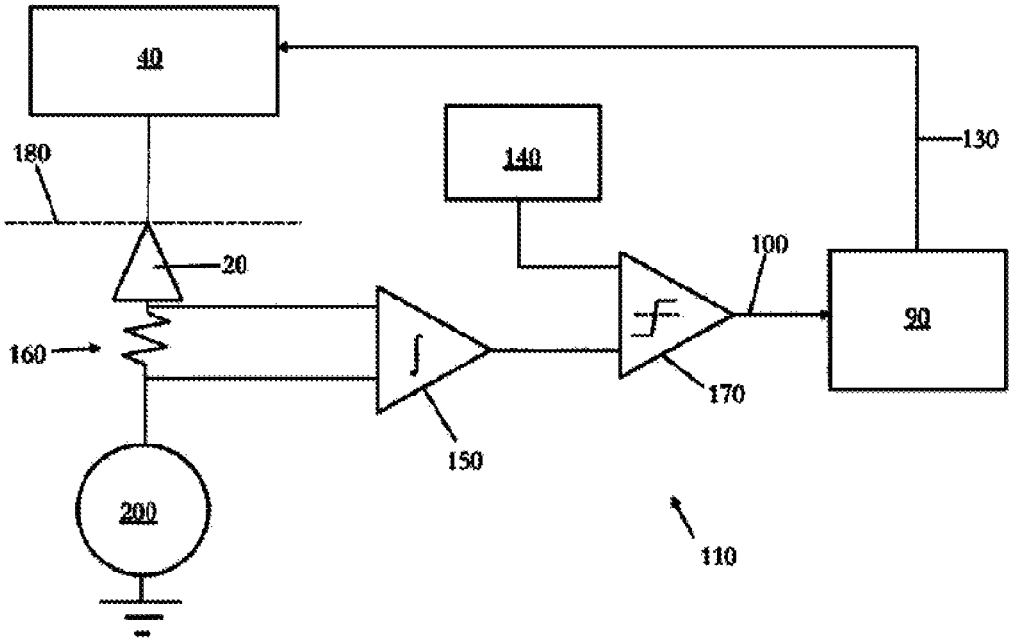
FIG. 3 is an example circuit.

An example sensing circuit 110 is shown schematically in FIG. 3. The coils 40 are controllable by the controller 90 via control line 130. The controller 90 receives information via line 100 from a comparator circuit 170 which, in turn, receives an input from an integrating circuit 150. The comparator circuit also compares the total measured charge, as received from the integrating circuit 150, with the threshold value provided by a memory storage means, or solid state component 140. The comparator circuit may comprise op-amps, transistors and a combination of resistors and capacitors.

The integrating circuit 150 receives information from the current measurement resistor 160, which is connected in between the high voltage supply 200 and an electron emitter 20. The voltage across this current measurement (sensing) resistor is integrated by the integrating circuit 150. The integrating circuit may comprise op-amps, transistors and a combination of resistors/capacitors. The emitter (cathode) 20 emits electrons which are drawn to the target (anode). An optional gate 180 may be arranged between the emitter 20 and the coils 40. The coils 40 are controlled by the controller 90 and may act to divert the flow of electrons away, or towards a particular target material in response to the controller having been informed by the comparator circuit 170 that the requisite amount (threshold) of charge has been dissipated by the electron emitter. Until that threshold is reached the path of electrons may follow a different route, to strike a different target material, as controlled by the flux created, or not created, by the coils in response to the controller's instructions. In other words, the magnetic field/flux created by the magnetic field generators may "reach through" from behind the target and affect the direction of one or more path of electrons.

The invention claimed is:

1. An x-ray generator comprising an array of electron field emitters for producing paths of electrons, target material comprising x-ray photon producing material configured to emit x-ray photons in response to the incidence of produced electrons upon the target material, an array of magnetic-field generators for affecting the paths of the produced electrons from the array of electron field emitters such that one or more of the paths are divertable away from the x-ray photon producing material so as to reduce the production of x-ray photons by the said one or more paths of electrons, the generator further comprising a sensing circuit arranged to measure the amount of electrical charge emitted by the electron field emitters, and a controller for controlling the array of magnetic-field generators in response to the amount of electrical charge measured, wherein the controller is arranged to control one or more magnetic-field generators to thereby reduce production of x-ray photons resulting from the one or more paths of electrons when the amount of electrical charge, as measured by the sensing circuit in the one or more paths, exceeds a pre-determined threshold.

2. The x-ray generator of claim 1, wherein the sensing circuit is arranged between a power source, for the one or more electron emitters, and the electron emitters.

3. The x-ray generator of claim 1, further comprising an emission field controlling grid located between the electron emitters and the target material, and the sensing circuit is arranged between a power source for the electron emitters and the controlling grid.

4. The x-ray generator according to claim 1, wherein the target further comprises non-photon producing material onto which the one or more paths of electrons are divertable by the magnetic-field generators so as to reduce the production of x-ray photons by the said one or more paths of electrons.

5. An x-ray generator according to claim 4, wherein the non-photon producing material is silicon.

6. The x-ray generator according to claim 1, arranged such that the generation of x-rays is controllable without altering a supply of power to the array of electron field emitters.

7. The x-ray generator according to claim 1, wherein the magnetic-field generators are energisable solenoid coils.

8. The x-ray generator according to claim 1, wherein the magnetic-field generators defocus the paths of the electrons.

9. The x-ray generator according to claim 1, wherein the x-ray photon producing material in the target material is arranged in a regular pattern of discrete areas.

10. An x-ray generator according to claim 1, wherein the target material further comprises a thin sheet of x-ray absorbing material positioned on the side away from the electron field emitters.

11. An x-ray generator according to claim 10, wherein the x-ray absorbing material comprises aluminium of thickness in the range 0.1 cm to 1 cm.

12. An x-ray generator according to claim 1, wherein a plurality of magnetic lenses is positioned adjacent to the plurality of magnetic-field generators, the magnetic lenses being arranged such that in use they concentrate the field flux towards the centre of the emitter array.

13. An x-ray generator according to claim 1, wherein the controller also controls each magnetic-field generator.

14. An x-ray generator according to claim 13, wherein the controller is configured such that adjacent magnetic-field generators are operable in a raster sequence within 1 ms to 5 ms of each other.

15. An x-ray generator according to claim 13, wherein the controller is configured to operate a number of magnetic-field generators simultaneously.

16. An x-ray generator according to claim 15, wherein the controller is configured to operate a number of magnetic-field generators simultaneously as synchronised by a clock signal.

17. A method of obtaining an x-ray image of an object, comprising the steps of:

providing an x-ray generator comprising an array of electron field emitters for producing paths of electrons, target material comprising x-ray photon producing material configured to emit x-ray photons in response to the incidence of produced electrons upon the target material, an array of magnetic-field generators for affecting the paths of the produced electrons from the array of electron field emitters such that one or more of the paths are divertable away from the x-ray photon producing material so as to reduce the production of x-ray photons by the said one or more paths of electrons, the generator further comprising a sensing circuit arranged to measure the amount of electrical charge emitted by the electron emitters, and a controller for controlling the array of magnetic-field generators in response to the amount of electrical charge measured, wherein the controller is arranged to control one or more magnetic-field generators to thereby reduce production of x-ray photons resulting from the one or more paths of electrons when the amount of electrical charge, as measured by the sensing circuit in the one or more paths, exceeds a pre-determined threshold;

providing an x-ray detector; and operating said generator whereby x-ray photons pass through an object positioned between the x-ray generator and the x-ray detector.

18. The method of claim 17, wherein the sensing circuit measures the amount of electrical charge emitted by the electron emitters, and the controller controls the array of magnetic-field generators in response to the amount of electrical charge measured.

19. The method of claim 17, wherein the controller controls the array of magnetic-field generators so that the amount of charge emitted by each electron emitter is predetermined.

* * * * *